US005615444A

United States Patent [19]

Reye

[11] Patent Number: 5,615,444

[45] Date of Patent: Apr. 1, 1997

[54] ROLLER PRINTER FOR WALLS AND THE LIKE WITH LEVELING FEATURE

[76] Inventor: Barbara J. Reye, 4041 Edgewood Dr., Lorain, Ohio 44053

[21] Appl. No.: 520,752

[22] Filed: Aug. 29, 1995

[51] Int. Cl.[6] ..... B05D 5/00; B05C 17/02

[52] U.S. Cl. ..... 15/230.11; 401/218; 101/375; 7/164; 118/712; 118/DIG. 15; 492/13; 492/19

[58] Field of Search ..... 15/230.11, 230.1, 15/230, 230.12, 230.13, 230.14, 230.15, 230.16, 230.17, 230.18, 230.19; 401/208, 218, 219; 101/375–379; 7/163, 164, 150, 105; 118/712, DIG. 14, DIG. 15; 492/13, 19, 16, 18

[56] References Cited

U.S. PATENT DOCUMENTS

| | | | |
|---|---|---|---|
| 2,652,774 | 9/1953 | Sprung | 15/230.11 |
| 3,134,327 | 5/1964 | Sebonc | 401/218 |
| 4,852,259 | 8/1989 | Manserra | 7/163 |
| 5,000,671 | 3/1991 | Nolte | 15/230.11 |
| 5,046,387 | 9/1991 | Levake | 15/235.4 |

*Primary Examiner*—Gary K. Graham
*Attorney, Agent, or Firm*—Donald A. Bergquist

[57] ABSTRACT

An attachment is made to a roller printer that indicates to a user of the roller printer that it is tracking a straight line on a vertical surface. The attachment in the best mode is a spirit level so positioned that it indicates whether the printing roller of the roller printer is horizontally oriented in use. A protractor or other form of angle indicator may be used with a pivotable spirit level to aid the user of a roller printer in producing a pattern that extends inclined to the vertical.

4 Claims, 3 Drawing Sheets

ROLLER PRINTER FOR WALLS AND THE LIKE WITH LEVELING FEATURE

INTRODUCTION

This invention relates to roller printers for applying a decorative pattern of paint to a wall or a generally vertical wall-like surface. More specifically, this invention introduces to such roller printers a levelling feature that ensures that the roller printer produces an elongated pattern that extends either vertically or at a constant or a predetermined angle to the vertical, thereby to produce a pattern having a professional appearance, even at the hands of a novice.

PRIOR ART

It has long been known to apply an elongated, repetitive decorative pattern of paint or other coloring material to a wall or a generally vertical wall-like surface. Often, this pattern is generated by using stencils. It has also long been known to apply such a pattern with a roller printer. Although no such prior an has been found by the present inventor in the patent literature or other print media, the inventor is in possession of such a device that was given her by her father. It is believed that this particular roller printer is of European manufacture more than three decades ago.

The hand-held roller printer has a single stem-like handle centrally supporting a yoke having two substantially parallel arms that support a plurality of serially-engaging rollers therebetween, each of which rollers can rotate on its own central axis while contacting at plural points along its length at least one of the other rollers, the uppermost roller having an outer cylindrical shell having a raised pattern thereon, the pattern being a mirror image of the pattern desired to be applied to the wall, and the lowermost roller having a portion thereof within the confines of a horizontal part designed to hold paint or other coloring material and also supported between said parallel arms. In practice, the uppermost roller is removable and may be replaced with any one of a number of differently patterned rollers. In another variation, the outer shell of the uppermost roller may be removed and may be replaced with any one of a number of differently patterned cylindrical shells. These patterns may be such that they generate a continuous pattern that repeats upon each rotation of the roller, or, with suitable modifications of the roller system, they may be discrete single motifs that are repeated upon each rotation of the roller.

In use, as the uppermost, or first roller is rolled along a surface, friction between the wall and the first roller along the substantially linear contact therebetween causes the first roller to rotate on its axis. Friction between the first roller and the next, or second roller along the substantially linear contact therebetween causes the second roller, likewise, to rotate on its axis. Friction between the second roller and the next, or third roller along the substantially linear contact therebetween causes the third roller, in turn to rotate on its axis. Friction between the third roller and the next, or fourth roller along the substantially linear contact therebetween causes the fourth roller, finally, to rotate on its axis. Because in use the fourth roller is partly immersed along its entire length in paint or other coloring material within the part, as it rotates, it transports a portion of that paint to the third roller. Paint is transferred thence to the second roller and thence to the raised portions of the first roller and ultimately to the wall in the desired pattern..

This roller printer can generate a single path of a repeating pattern on a wall. Coverage of a greater portion of the surface of a wall can be attained by a plurality of parallel single paths generated by the roller printer. Substantially full coverage of a wall can thus be attained. With care, patterns of different colors can overlay previously laid-down patterns.

In the sample at hand, the intermediate roller 3 carries circumferential grooves, presumably to more evenly distribute paint to roller 2, from which the paint is deposited onto the patterned first roller for transfer to the wall. Additionally, roller 2 is mounted in the yoke in a manner that allows it motion transverse to its axis. It is presumed that this motion allows for the use of different printer rollers having somewhat different diameters. There may be more sophisticated details of the roller system for reasons that are not here presented. It should be sufficient to say that this roller printer is known in the art and the present invention is an adjunct to the existing product that enables professional looking results from use of the roller printer by an amateur.

As long as the outermost surface—comprising the peaks of the raised pattern—of the first roller is a true convex cylinder, that is, a surface generated by the translational motion of a straight line around a continuously convex closed curve, the roller printer will track a straight line on a flat surface. The most common shape for the outermost surface of the first roller is that of a right circular cylinder—the figure generated by a straight line traversing a circular pattern wherein the line is always normal to (i.e., at right angles to) the plane of the circular pattern.

Other hand-held roller printers are also available that transfer ink from an ink pad onto a flat surface. These roller printers are designed for priming borders on paper or other media. The principle of operation is similar to, but much simpler than that of the roller printer described above. Such simple roller printers have no need for multiple rollers; only the priming roller and an ink pad. It would likely be considered obvious to mourn an ink pad in the form of a roller to be in contact with a priming roller of such a simple roller printer, thereby to allow continuous re-inking of the printing roller for transferring a pattern to a wall or other extended surface. The present invention could be adapted to all roller printers of such simple ink pad design, as well as those employing a part for the coloring medium.

The problem addressed by the present invention is that of ensuring that the straight line being tracked by the roller printer on the wall is truly vertical, which is usually desired. A supplemental embodiment allows for similarly ensuring that the tracking line is always at a predetermined angle from the vertical. Without a mechanical means to indicate the desired angle of the tracking line, the inexperienced operator will surely go astray, resulting in an undesirable and unprofessional-looking output. Because we never truly achieve the ideal situation wherein the pattern on the printing roller is truly cylindrical and no slippage occurs between the patterned printing roller and the wall, real-world problems require the user to exert directing forces on the handle to compensate for a non-linear tracking of the priming roller. It is for the guidance of the user exerting these directing forces that the present invention exists.

SUMMARY OF THE INVENTION

Therefore it is an object of this invention to provide a roller printer incorporating a spirit level to allow a user thereof to ensure that the axis of the printing roller is precisely horizontal, thereby to ensure that the printing roller will track, as precisely as possible, a truly vertical path.

It is another object of this invention to provide a roller printer incorporating a spirit level that is pivotably mounted on the roller printer to allow a user thereof to ensure that the axis of the priming roller is always held at the same angle to the horizontal, thereby to ensure that the printing roller will track, as precisely as possible, a path that is always at the same angle to the vertical.

It is another object of this invention to provide a roller printer incorporating a spirit level that is pivotably mounted on the roller printer in conjunction with an angle-indicating device, to allow a user thereof to ensure that the axis of the printing roller is always held at a preselected angle to the horizontal, thereby to ensure that the printing roller will track, as precisely as possible, a path that is always at the selected angle to the vertical.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE BEST MODE OF THE INVENTION

This invention will be most easily understood by referring to the attached drawings, wherein parts are identified by reference numbers consistent with the following description. In each view, the same part carries the same reference number.

Figure 1:
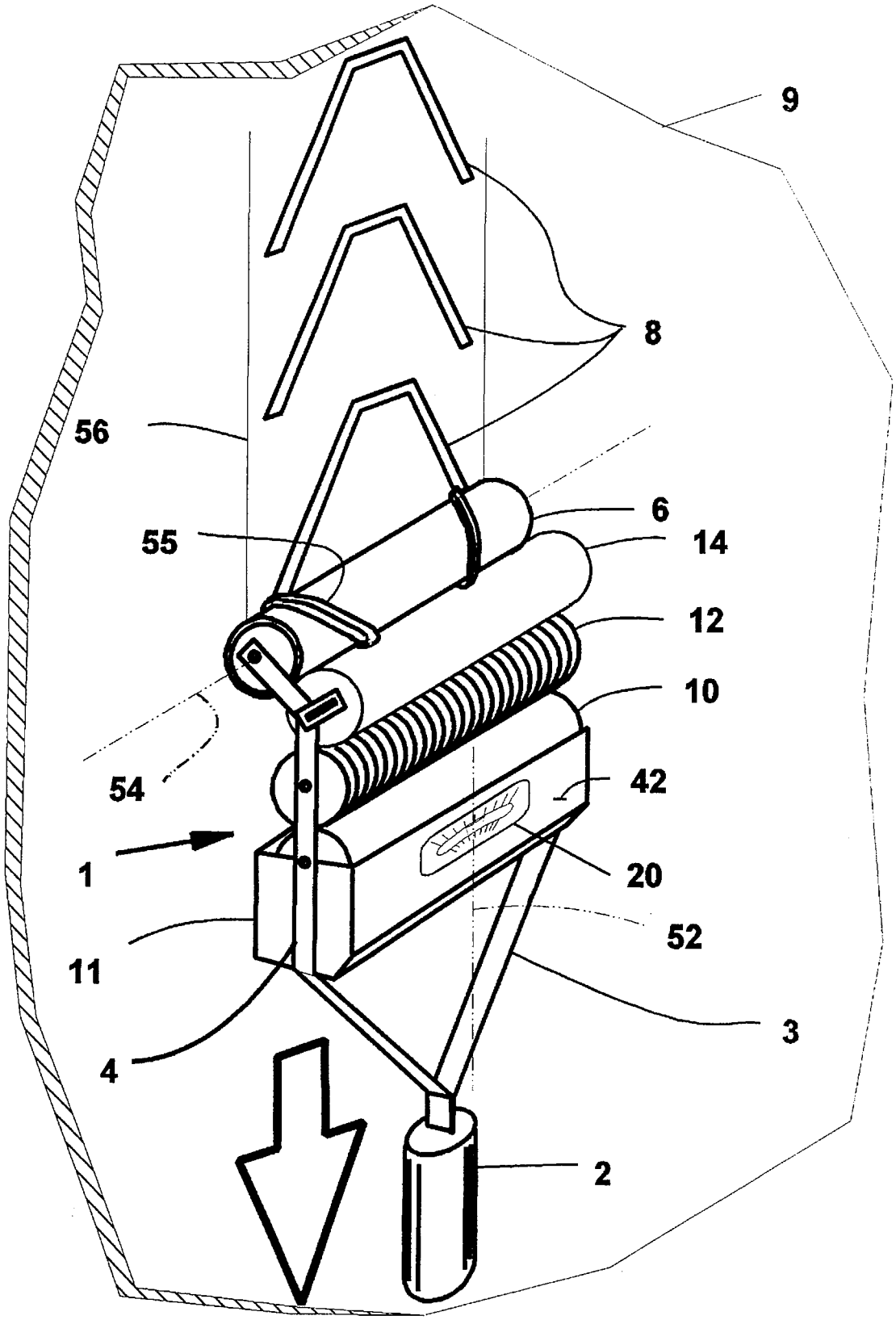
FIG. 1 illustrates the prior art roller printer with the invention applied thereto.

By way of illustrating the prior art upon which this invention is based, and for which no prior publication can be cited, FIG. 1 shows a view of the prior art device 1 with the present invention 20 applied thereto.

The figure illustrates the various parts of the prior art device 1. These include handle 2, yoke 3, and one of two parallel arms 4 supporting a plurality of serially-engaging rollers 10, 12, 14, and 6, therebetween. The uppermost roller 6 has an outer cylindrical shell having a raised pattern 55 thereon, the pattern being a mirror image of the pattern 8 desired to be applied to the wall or other substantially vertical surface 9, and the lowermost roller 10 having a portion thereof within the confines of horizontal part 11 designed to hold paint or other coloring material. The uppermost roller 6 is removable and may be replaced with any one of a number of differently patterned rollers. In another variation, as here shown, the outer shell of the uppermost roller 6 may be removed and may be replaced with any one of a number of differently patterned cylindrical shells.

In use, paint is transferred by the series of rollers to the raised portions of the first roller 6 and ultimately to the wall in the desired pattern 8. Because the raised portion 55 of printing roller 6 is carefully designed to define a cylinder concentric with the roller itself, the track 56 of the pattern 8 is perpendicular to the axis 54 of this roller. The motion of the roller printer, indicated by the large arrow, is perpendicular to the roller axis 54. It is clear that if the roller axis 54 is truly horizontal, then the path 56 of the pattern 8 will be truly vertical, which is quite desirable.

The present invention provides a spirit level 20 or other level-indicating device mounted on a portion of the roller printer 1 in a manner to indicate when the roller axis 54 is truly horizontal. Thus, while the level indicates alignment with the vertical axis 52, the user of the invention can be assured that the track 56 of the pattern will be vertical.

Figure 2:
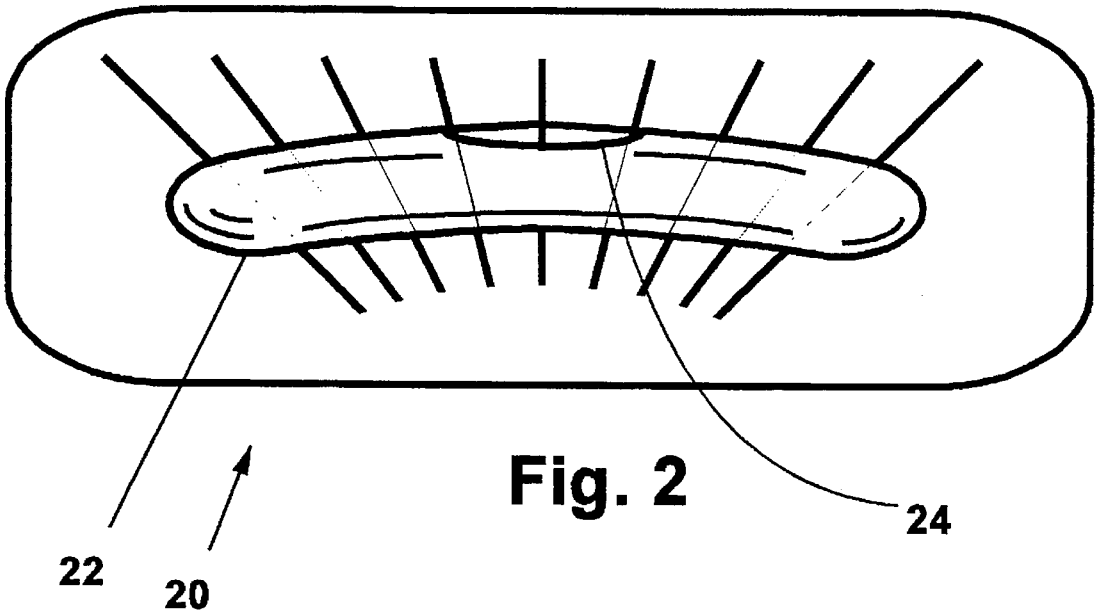
FIG. 2 illustrates in a detail view of the spirit level that is part of the invention.
Figure 3:
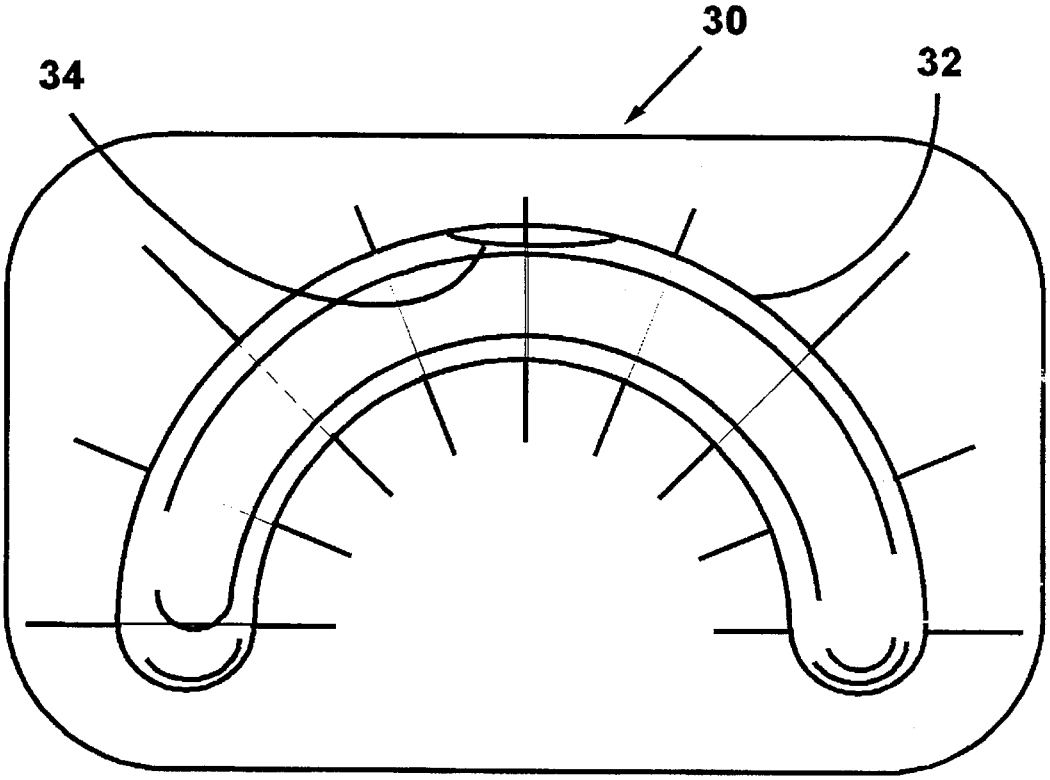
FIG. 3 illustrates a second spirit level that could be used in the invention.

Illustrations of suitable spirit level devices are shown in FIG. 2 and FIG. 3. FIG. 2 illustrates a rather conventional spirit level device 20 comprising a liquid all but filling a glass vial 22, thereby leaving a bubble 24 that will always seek the uppermost portion of the curved vial, thereby indicating a direction contrary to the gravitational direction, usually referred to as the vertical direction, here indicated by the vertical axis 52. The spirit level 30 illustrated in FIG. 3 is like that of FIG. 2, but has a more pronounced curvature to the glass vial 32 so that the bubble 34 can indicate over a much wider range of angles the degree of deviation from the vertical. Such a device would be useful were the user of the roller printer wish the path 56 of the pattern being printed to be at a constant angle relative to the vertical. Thus, a border could accurately be printed on a flat wall that abuts a sloping wall, as in an attic room or one using such an architectural feature.

Figure 4:
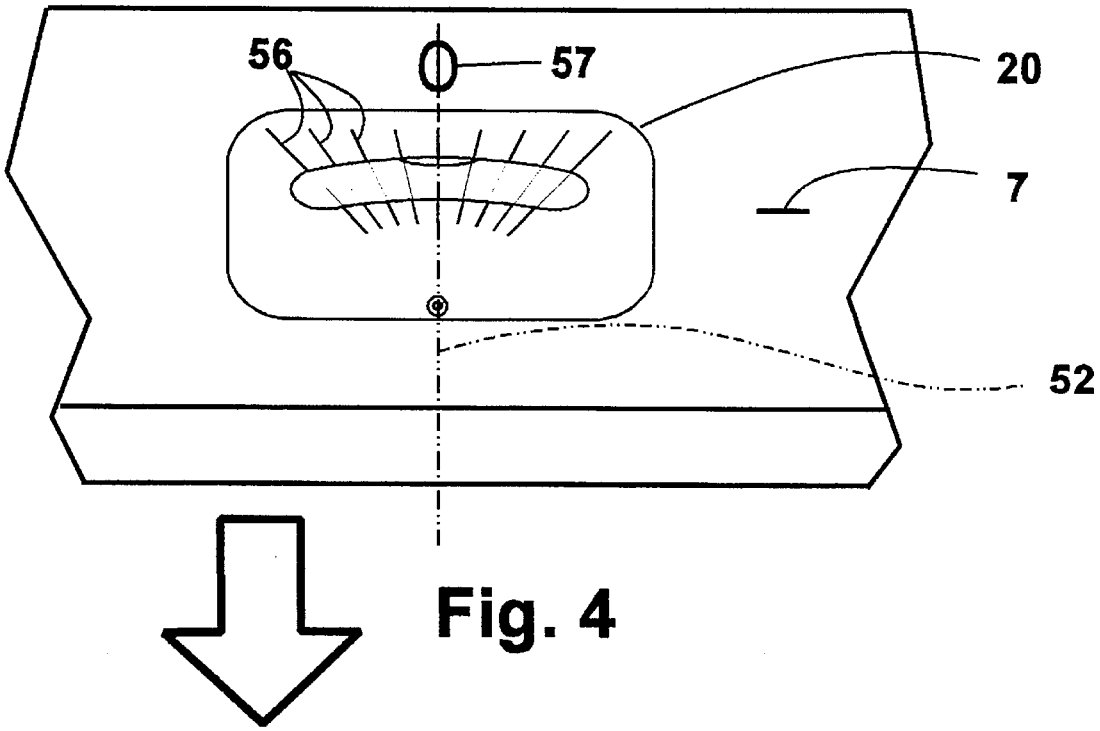
FIG. 4 illustrates a partial view of the roller printer of FIG. 1 to illustrate details of the invention.
Figure 5:
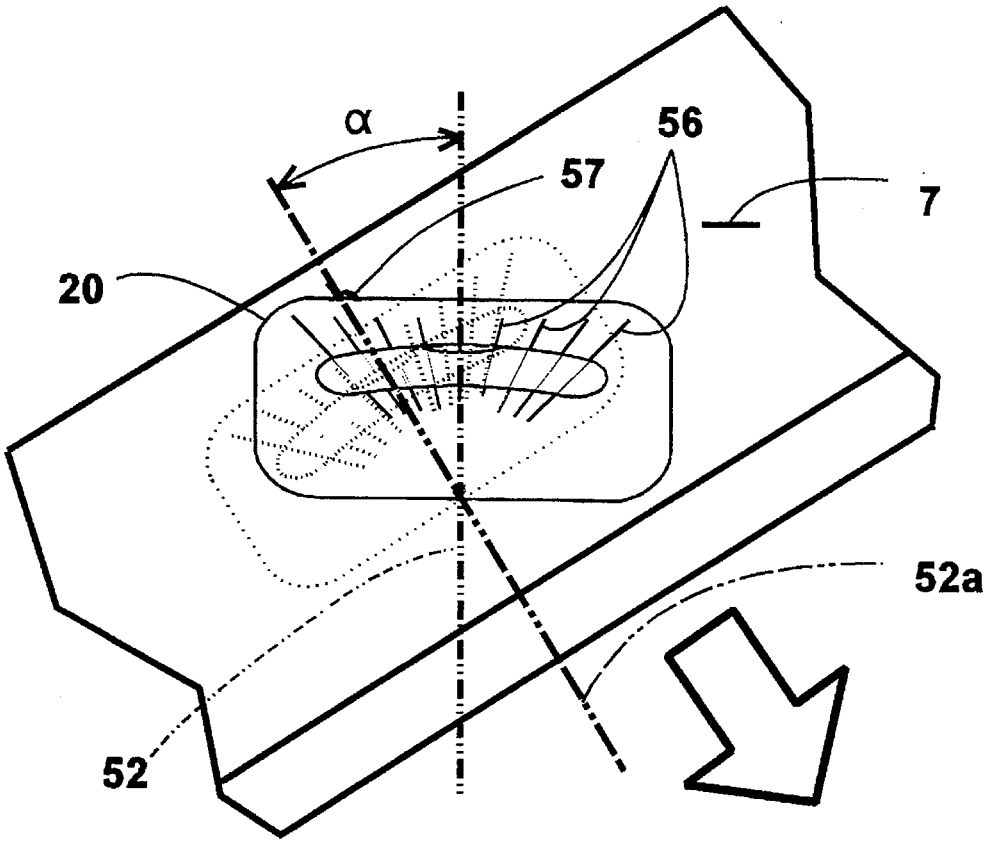
FIG. 5 illustrates a modification of the invention that allows for flexibility of use thereof.

To amplify this point with another variation, FIG. 4 shows spirit level 20 mourned on a flat surface 7 of the roller printer, which surface is substantially vertically oriented in use. The direction of travel indicated by the large arrow is in alignment with the vertical 52, as indicated by the level, so a vertical pattern path will result. In FIG. 5, the level has been pivoted from its normal position through an angle $\alpha$ (alpha). Indicators 56 are present that, in combination with a fixed mark 57 on surface 7, show the magnitude of angle $\alpha$ so reproducible results can be attained between one use and another. Now, when the bubble indicates the vertical 52 on the spirit level, the direction of motion 52*a* will be at an angle $\alpha$ to the vertical, thereby creating a pattern along a path that is at an angle $\alpha$ to the vertical. In practice, the spirit level may be pivotably mounted by obvious means to provide this flexibility of use.

Whereas the particular roller printer shown here is best used on a substantially vertical surface, it (or similar apparatus) could be used on a sloping wall also, and the present invention could be useful in such a use.

Having described this invention, including the citing of functional specific examples thereof, applicant desires to include within the scope of the invention those improvements that would be immediately obvious to one skilled in the art, some, but not all of which improvements may have been referred to herein. Applicant desires the breadth of his invention to be limited only by the scope of the claims appended hereto.

I claim:

1. In a hand-held roller printer for transferring a design from a priming roller to a substantially vertical surface, which printing roller rotates on an axis central thereto and moves in a transverse direction perpendicular to said axis as it rolls upon a surface to transfer said design, the improvement comprising means for indicating to a user thereof whether the axis of said printing roller of said roller printer is being maintained at a constant angle to the horizontal, thereby to ensure straight tracking thereof along said vertical surface.

2. The hand-held roller printer of claim 1 wherein said means for indicating comprises a spirit level mounted on a planar part of said roller printer that in use is substantially vertically oriented and parallel to said printing roller axis.

3. The hand-held roller printer of claim 2 wherein said spirit level is attached by a pivoting mounting means.

4. The hand-held roller printer of claim 3 wherein said pivoting mounting means includes means for indicating a relative angle between the axis of said printing roller and said spirit level.

* * * * *